US010774526B1

(12) United States Patent
Kenyon, III et al.

(10) Patent No.: US 10,774,526 B1
(45) Date of Patent: Sep. 15, 2020

(54) CEMENT BOARD WALL SYSTEM

(71) Applicant: Nehemiah Elite Wall Systems, Inc., Phoenix, AZ (US)

(72) Inventors: John W. Kenyon, III, Del Mar, CA (US); Rudy N. Diaz, Jr., Murrieta, CA (US)

(73) Assignee: Nehemiah Elite Wall Systems, Inc., Phoenix, AZ (US)

( * ) Notice: Subject to any disclaimer, the term of this patent is extended or adjusted under 35 U.S.C. 154(b) by 0 days.

(21) Appl. No.: 16/374,179

(22) Filed: Apr. 3, 2019

(51) Int. Cl.

| | |
|---|---|
| ***E04B 2/72*** | (2006.01) |
| ***E04F 13/077*** | (2006.01) |
| ***E04F 13/075*** | (2006.01) |
| ***E04B 2/28*** | (2006.01) |
| ***E04B 2/92*** | (2006.01) |
| *E04B 2/74* | (2006.01) |
| *E04B 2/84* | (2006.01) |
| *E04B 2/02* | (2006.01) |

(52) U.S. Cl.
CPC ..... *E04B 2/723* (2013.01); *E04B 2/28* (2013.01); *E04B 2/92* (2013.01); *E04F 13/075* (2013.01); *E04F 13/077* (2013.01); *E04B 2/845* (2013.01); *E04B 2002/0286* (2013.01); *E04B 2002/7472* (2013.01); *E04B 2002/7477* (2013.01); *E04B 2103/04* (2013.01); *E04F 2203/04* (2013.01); *E04F 2290/04* (2013.01)

(58) Field of Classification Search
CPC ..... E04B 2/28; E04B 2002/7472; E04B 2002/0286; E04B 1/665; E04B 2/707; E04F 2203/04; E02D 19/00
See application file for complete search history.

(56) References Cited

U.S. PATENT DOCUMENTS

| | | | | |
|---|---|---|---|---|
| 5,860,259 | A | 1/1999 | Laska | |
| 5,979,131 | A | 11/1999 | Remmele et al. | |
| 6,108,991 | A * | 8/2000 | Hagan | E04B 1/762 52/302.3 |
| 6,410,118 | B1 * | 6/2002 | Reicherts | B32B 13/04 428/141 |
| 6,745,531 | B1 * | 6/2004 | Egan | E04B 1/70 52/302.1 |
| 7,204,063 | B2 | 4/2007 | Kandalgaonkar | |
| 7,836,652 | B2 * | 11/2010 | Futterman | E04F 13/02 52/393 |
| 8,919,062 | B1 * | 12/2014 | Viness | E04F 13/04 52/220.5 |
| 2002/0108333 | A1 | 8/2002 | Clayton | |

(Continued)

FOREIGN PATENT DOCUMENTS

JP 3818971 B2 9/2006

OTHER PUBLICATIONS

USG Durock Brand Cement Board Systems Catalog, 2018.

*Primary Examiner* — Babajide A Demuren
(74) *Attorney, Agent, or Firm* — Womble Bond Dickinson (US) LLP; John J. Penny, Jr.

(57) ABSTRACT

A system comprising an inner cement wall board, an outer cement wall board, and a cement or concrete compatible adhesive formed between the fluid-applied water-resistive barrier and the outer cement wall board, wherein the cement or concrete compatible adhesive forms drainage channels between the inner cement wall board and the outer cement wall board.

16 Claims, 5 Drawing Sheets

(56) References Cited

U.S. PATENT DOCUMENTS

| | | | | |
|---|---|---|---|---|
| 2002/0182963 | A1* | 12/2002 | Bramlett | B32B 7/12 442/386 |
| 2006/0277854 | A1 | 12/2006 | Egan | |
| 2007/0294976 | A1* | 12/2007 | Fay | E04B 1/0046 52/515 |
| 2011/0078971 | A1* | 4/2011 | Adams | A01N 37/44 52/517 |
| 2011/0197528 | A1* | 8/2011 | Egan | E04B 1/762 52/302.1 |
| 2011/0258944 | A1* | 10/2011 | Radoane | E04B 2/58 52/62 |
| 2014/0096460 | A1* | 4/2014 | Toorell | E04B 2/707 52/169.11 |
| 2017/0275873 | A1* | 9/2017 | Ravellette | E04F 13/0866 |

* cited by examiner

CEMENT BOARD WALL SYSTEM

FIELD OF THE INVENTION

This present invention relates generally to exterior wall board systems used in the construction of residential and/or commercial buildings that provide a water-resistive barrier and shear strength, and more particularly to a cement wall board system.

BACKGROUND OF THE INVENTION

Building codes today require that certain walls of wood or steel framed buildings be capable of taking shear loads. Typically, ⅜ inch to ⅝ inch wood-based sheathing have been installed on the interior or exterior side of the framing studs to take such shear loads. It is common practice to install ½ inch to ⅝ inch thick drywall panels, such as gypsum wallboards, on the interior sides of the framing studs and a ⅞ inch stucco system or other suitable material with a water-resistive barrier on the exterior side of the framing studs.

In general, most wall board systems used in construction are susceptible to water and moisture intrusion, which can cause water damage and corrosion. Internal (hydration) cracks and external (stress) cracks, which can form as a result of installation error or building movement, can increase the amount of damage caused by the water intrusion.

Specifically, wood-based sheathing, lath and organic water-resistive barriers (such as building paper), which are used in typical stucco systems, are particularly susceptible to corrosion caused by water. For example, in a typical one-coat stucco system 100, wood-based sheathing such as plywood or OSB 110 is attached to studs/framing 120 using mechanical fasteners (not shown), as shown in FIG. 1. A water-resistive barrier 130 such as Grade D building paper is then attached to the wood-based sheathing 110 using staples (not shown). A one-inch tongue and groove foam insulation board 140, with woven wire lath 150 attached thereto, is then attached to the water-resistive barrier 130 using staples (not shown). A ⅜ inch brown coat 160 and a ⅛ inch finish coat 170 are then applied to the wire lath 150.

Similarly, in a three-coat stucco system 200 shown in FIG. 2, wood-based sheathing 210 is attached to studs/framing 220 using mechanical fasteners (not shown), as shown in FIG. 2. A water-resistive barrier 230 such as Grade D building paper 230 is then attached to the wood-based sheathing 210 using staples (not shown). A woven wire or expanded metal lath 240 is attached to the water-resistive barrier 230 using staples (not shown). A ⅜ inch scratch coat 250 is then applied over the water-resistive barrier 230 through the lath 240. A ⅜ inch brown coat 260 and a ⅛ inch finish coat 270 are then applied over the scratch coat 250 by hand or using a machine applicator (not shown).

In both the one-coat and three-coat systems described above, water can infiltrate the stucco layers, which can cause corrosion of the lath, water-resistive barrier, and wood-based sheathing. Accordingly, a new type of exterior wall board system is needed to solve these problems.

In a typical Exterior Insulation Finish System (EIFS) shown in FIG. 3, interior gypsum wallboard 305 is attached to the inside of the studs/framing 320 using mechanical fasteners (not shown). Glassmat gypsum sheathing 310 is attached to the outside of the studs/framing 320 using mechanical fasteners (not shown). A fluid-applied water/air barrier 340 is applied on the Glassmat gypsum sheathing

310. An adhesive layer 330 is applied to the fluid-applied water/air barrier 340 to bond a non-structural EPS foam insulation board 350 to the fluid-applied water/air barrier 340. Drainage channels 355 are formed in the EPS foam insulation board 350 by cutting out vertical strips in the EPS foam insulation board 350. A reinforcing mesh 360 is adhered to the EPS insulation board 350 followed by a base coat 370 and a finish coat 380. Some of the disadvantages of an EIFS 300 are that it does not provide sufficient shear force resistance and its inherent frailty would make it less durable and more susceptible to damage from exterior forces when compared to other cement-based, masonry-based, or wood-based wall systems. For example, naturally occurring solar heat may melt the EPS foam causing it to prematurely delaminate and the lower (reachable) surface may be prone to exterior impact damage.]

Another problem with the aforementioned wall board systems is that the system is complicated and produces a lot of waste materials, which makes clean up more burdensome.

SUMMARY

At least one embodiment of the present invention is directed towards a novel exterior cement wall board system that can provide shear strength, protection from water/moisture damage without using any wood-based sheathing and/or building paper or any other component that can suffer from water damage. Specifically, at least one embodiment of the present invention combines drainage channels with a structural board such as a cement board. In at least one embodiment, this is done by forming the cement or concrete compatible adhesive with the proper thickness and spacing behind the cement board. The cement board system does not require any metal lath, wood-based sheathing and/or building paper or any other component that can suffer from water damage. The system also reduces construction time, minimizes clean up, and is more durable than other exterior wall systems such as an EIFS.

These and other features and advantages will be apparent from a reading of the following detailed description and a review of the associated drawings. It is to be understood that both the foregoing general description and the following detailed description are explanatory only and are not restrictive of aspects as claimed.

BRIEF DESCRIPTION OF THE DRAWINGS

The invention will be more fully understood by reference to the detailed description, in conjunction with the following figures, wherein.

DETAILED DESCRIPTION

Figure 1:
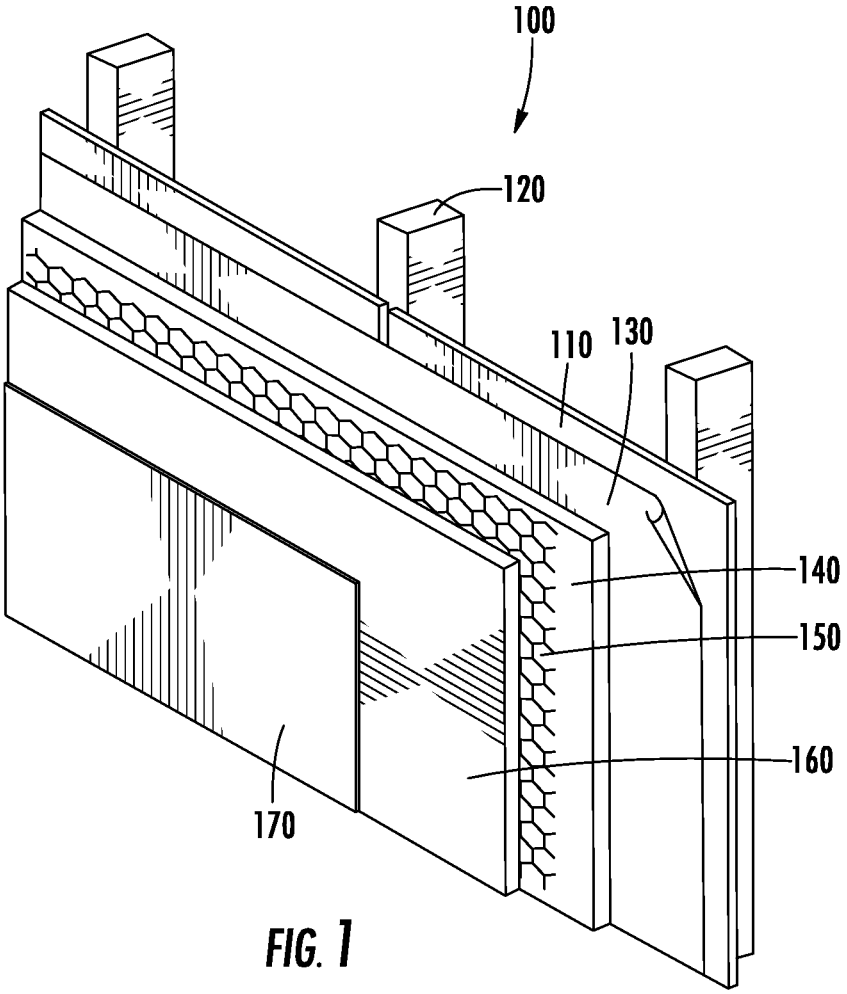
FIG. 1 (PRIOR ART)
FIG. 1 shows a traditional one-coat system stucco system.
Figure 2:
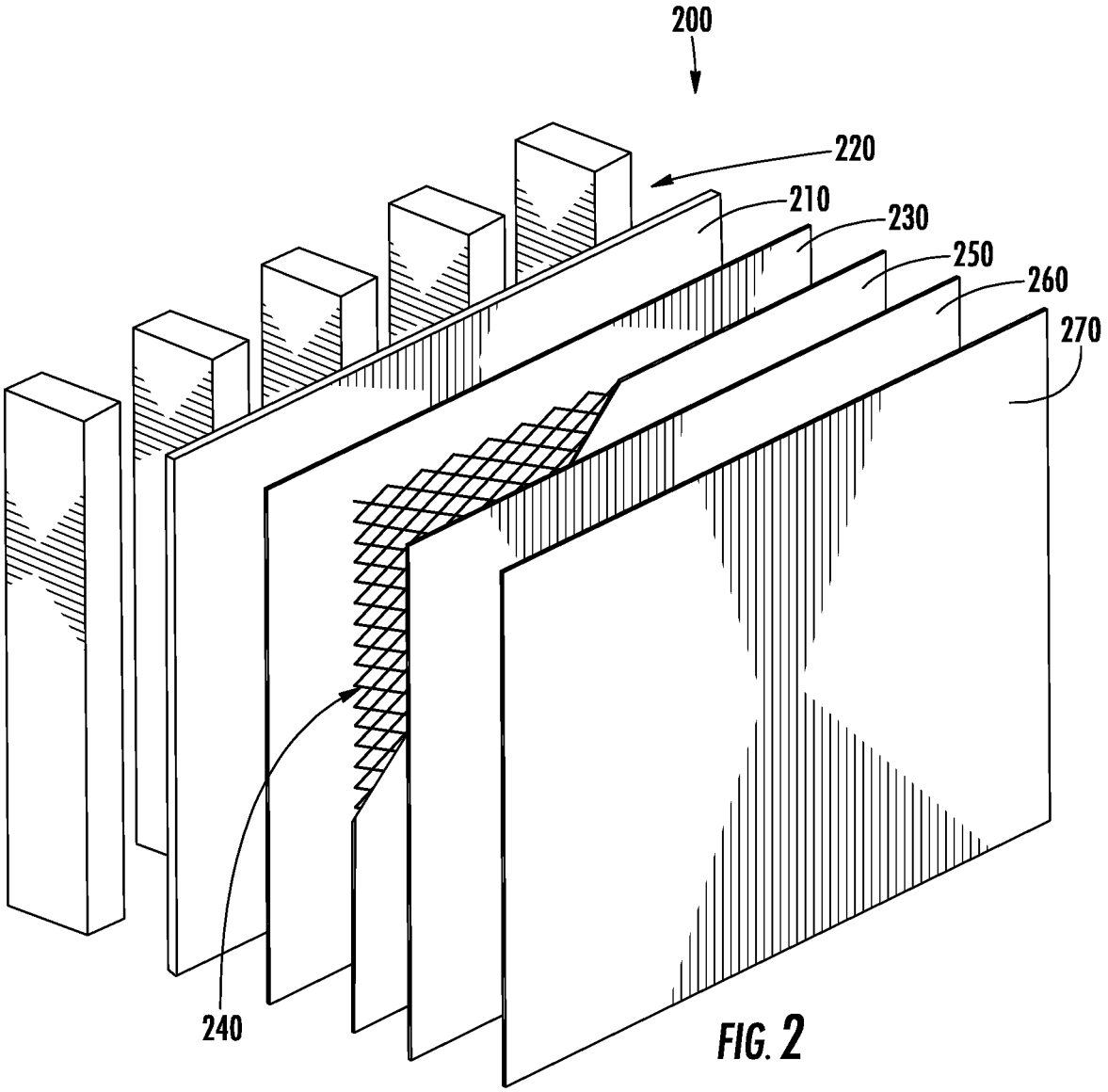
FIG. 2 (PRIOR ART)
FIG. 2 shows a traditional three-coat system stucco system.
Figure 3:
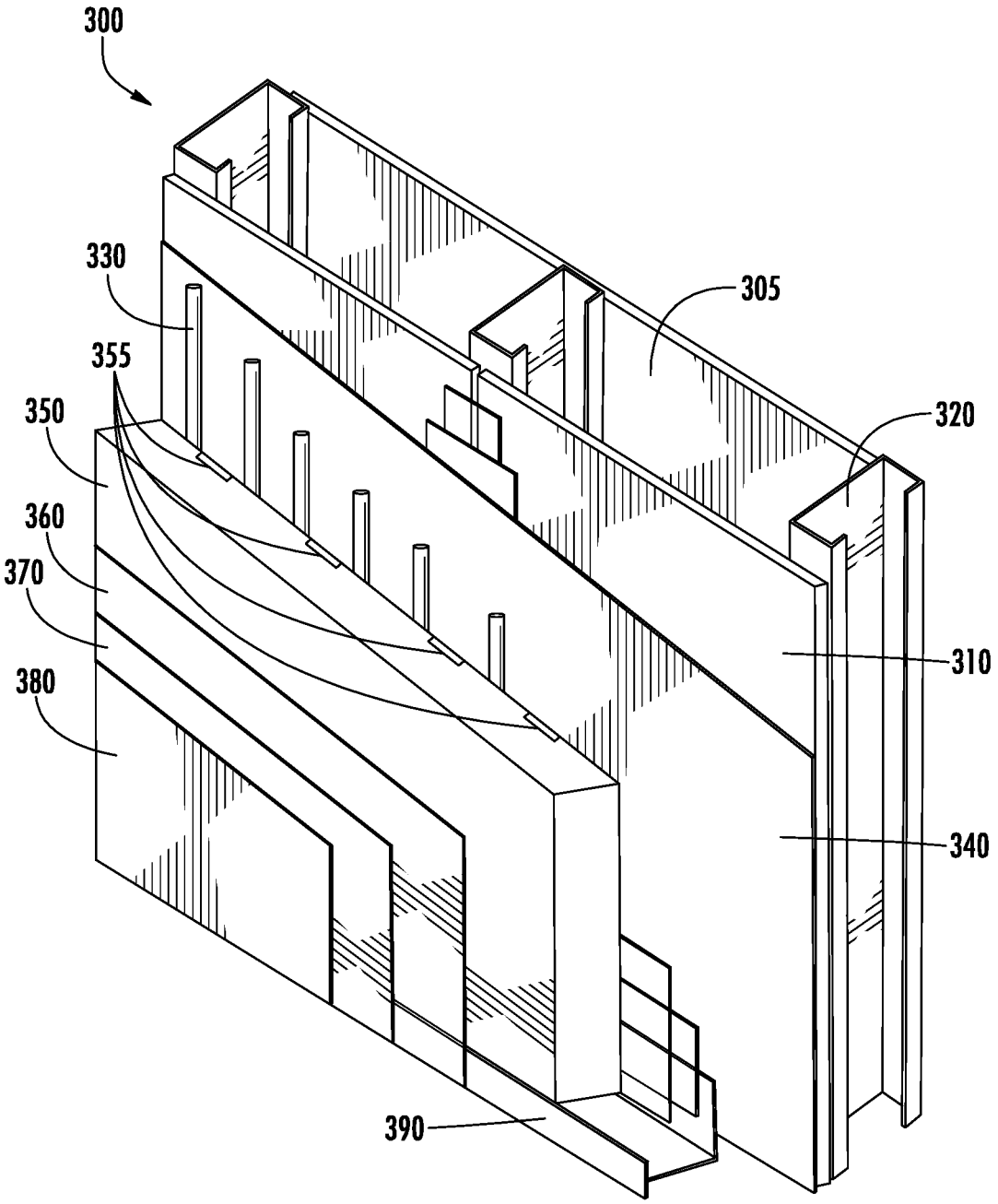
FIG. 3 is an Exterior Insulation Finish System (EIFS).

The subject innovation is now described with reference to the drawings, wherein like reference numerals are used to refer to like elements throughout. In the following description, for purposes of explanation, numerals specific details are set forth in order to provide a thorough understanding of the present invention. It may be evident, however, that the present invention may be practiced without these specific details.

Figure 4:
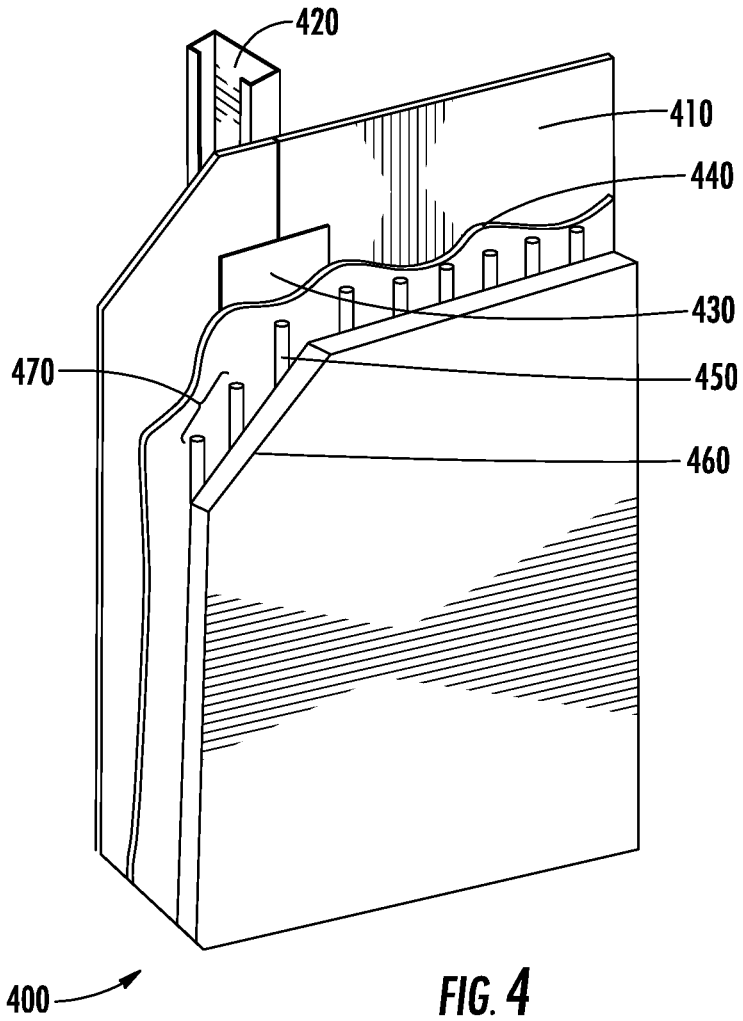
FIG. 4 is shows an exemplary embodiment of the present invention.

As shown in FIG. 4, an exemplary embodiment of the cement board system 400 of the present invention includes an inner cement wall board 410 that can be attached to studs/framing 420 using glue and/or screws. For the inner cement wall board 410, a nominal ⅜ inch or ½ inch thick cement board that is functionally equivalent to the cement boards manufactured by Nehemiah Elite Wall Systems, Inc. can be used. An approved water-resistive joint treatment 430 shall be applied to the inner cement wall board 410 in the region where the inner cement wall board 410 is attached to the studs 420 in order to seal the joints formed when the inner cement wall board 410 is attached to the studs 420.

A fluid-applied water-resistive barrier 440 is adhered to the outer surface of the inner cement wall board 410. This fluid-applied water-resistive barrier 440 can be sprayed or rolled on the outer surface of the inner cement wall board 410 to a thickness of approximately 10-12 wet mils. Parex WeatherSeal can be used as the fluid-applied water-resistive barrier 440. Also, any fluid-applied water-resistive barrier that complies with IBC Section 1404.2 or IBC Section R703.2 can be used. A cement or concrete compatible adhesive 450 is applied to the fluid-applied water-resistive-barrier 440 to adhere an outer cement board 460 to the fluid-applied water-resistive barrier 440/inner cement wall board 410. For the outer cement wall board 460, a nominal ⅜ inch or ½ inch cement board that is functionally equivalent to the cement boards manufactured by Nehemiah Elite Wall Systems, Inc. can be used. An adhesive such as Teifs Base EIFS Basecoat & Adhesive can be used as the cement or concrete compatible adhesive. The cement or concrete compatible adhesive 450 is applied in an amount sufficient to adhere the outer cement board 460 to the water-resistive-barrier 440/inner cement board 410 such that drainage channels 470 are formed between the water-resistive barrier 440 and the outer cement board 460. That is, the drainage channels 470 are formed within the cement board system between the inner cement wall board 410 and the outer cement board 460.

The drainage channels 470 can drain water and moisture trapped within the board system, which can prevent water damage. The drainage channels 470 can be formed, for example, by applying the cement or concrete compatible adhesive 450 in the form of vertical strips spaced approximately ¾ to 1½ inches apart with each strip having a width and thickness of approximately ⅜ inch. The vertical strips extend substantially the entire height of the cement boards 410/460. Therefore, the system of the present invention forms a water-resistive barrier, and a drainage system to remove any water/moisture that occurs.

The cement board system described herein combines structural support through the cement wall boards and drainage by the drainage channels formed between the inner and outer cement boards. Also, said cement board system does not require any wood-based sheathing or organic water-resistive barriers that can be prone to water damage.

Figure 5:
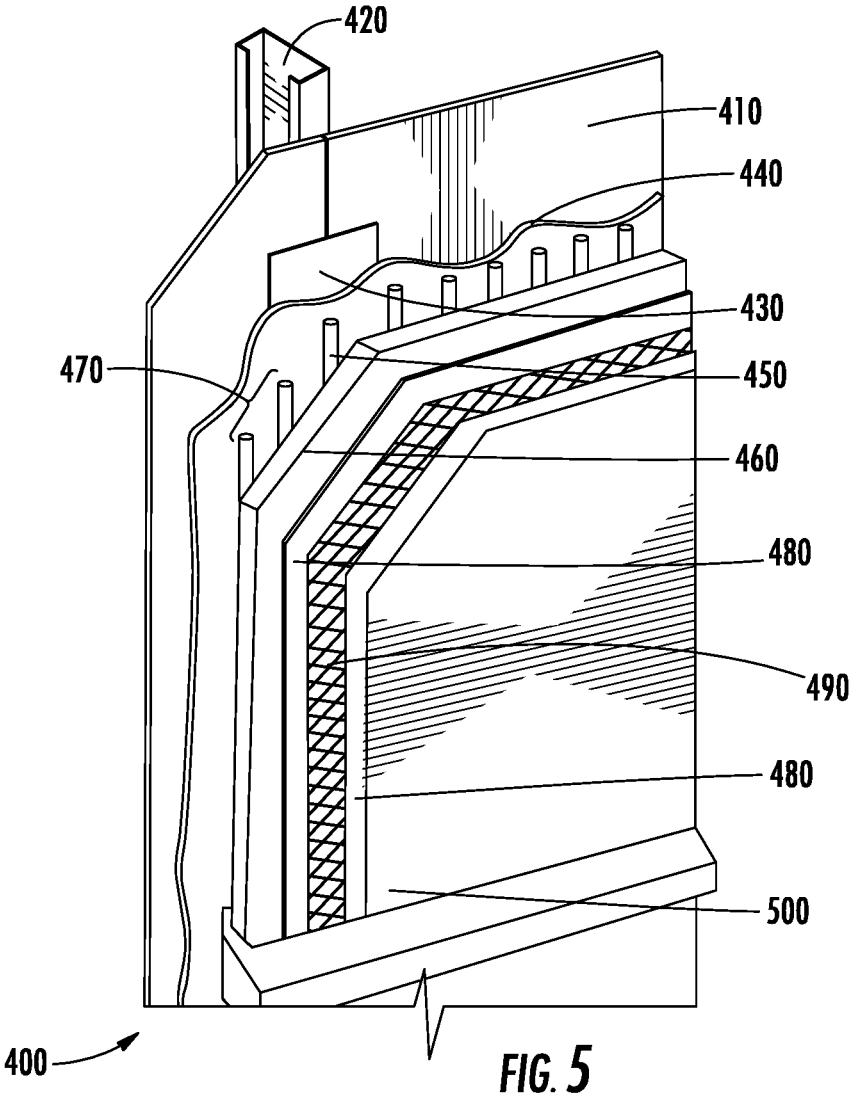
FIG. 5 is shows a second embodiment of the present invention.

After the cement board system 400 is fastened to the studs 420, two (2) layers of approved base coat 480 with a fiberglass mesh 490 adhered therebetween can be applied to the outside of the outer cement board 460 in order to seal the outer cement board 460, as shown in FIG. 5. An acrylic-based water-resistive finish coat 500 can be applied to the outer surface of the outer approved base coat 480. For the approved base coat 480, Teifs Base EIFS Basecoat & Adhesive could be used in a thickness of approximately ⅛ inch. For the fiberglass mesh 490, Parex Standard, Long Standard and Short Detail Mesh could be used. For the finish coat 500, TeifsFlex Acrylic Finishes could be used in a thickness of approximately ⅛ inch.

The system shown in FIG. 5 therefore can be used as a structural component that can provide shear strength, protection from water damage, as well as exterior cladding, without using wood-based sheathing or organic water-resistive barriers such as Grade D building paper or any other component that can suffer from water/moisture damage. Furthermore, the system shown in FIG. 5 can be installed in a reduced amount of time, which reduces construction time. In addition, the clean-up required for the system shown in FIG. 5 is simple since there is a reduced amount of debris, such as stucco spoils.

The cement board system 400 of the present invention can be used with a perforated starter track similar to a termination (weep) screed used in a typical stucco system at the bottom of the wall board system 400.

It should be understood that the invention is not limited by the specific embodiments described herein, which are offered by way of example and not by way of limitation. Variations and modifications of the above-described embodiments and its various aspects will be apparent to one skilled in the art and fall within the scope of the invention, as set forth in the following claims. For example, various similar materials can be used in the cement board system without departing from the scope of the invention.

What is claimed is:

1. A system comprising:

an inner cement wall board directly attached to studs with glue;

a fluid-applied water-resistive barrier applied to an outer surface of the inner cement wall board;

an outer cement wall board; and a cement or concrete compatible adhesive adhered between the fluid-applied water-resistive barrier and the outer cement wall board, wherein the cement or concrete compatible adhesive forms drainage channels between the inner cement wall board and the outer cement wall board.

2. The system of claim 1, wherein the cement or concrete compatible adhesive forms a plurality of vertical strips spaced a predetermined distance from adjacent vertical strips.

3. The system of claim 2, wherein said predetermined distance is approximately ¾ to 1½ inches.

4. The system of claim 2, wherein the vertical strips are approximately ⅜ inch in thickness.

5. The system of claim 1, wherein the inner cement wall board is attached to the studs using glue and screws.

6. A system comprising:

an inner cement wall board directly attached to studs with glue;

an outer cement wall board; and a cement or concrete compatible adhesive adhered between the inner cement wall board and the outer cement wall board, wherein the cement or concrete compatible adhesive forms drainage channels between the inner cement wall board and the outer cement wall board.

7. A system comprising:

an inner cement wall board directly attached to studs with glue;

a fluid-applied water-resistive barrier applied to an outer surface of the inner cement wall board;

an outer cement wall board;

a cement or concrete compatible adhesive adhered between the fluid-applied water-resistive barrier and the outer cement wall board, wherein the cement or concrete compatible adhesive forms drainage channels between the inner cement wall board and the outer cement wall board; and a base coat applied to the outer surface of the outer cement wall board.

8. The system of claim 7, further including a second base coat layer applied to the base coat with a fiberglass mesh adhered therebetween; and an acrylic-based water-resistive finish coat applied to the outer surface of the outer base coat.

9. The system of claim 5, further including a system at the bottom of the wall board system to facilitate drainage of water and moisture.

10. A method of installing a cement wall system in a building comprising:

attaching an inner cement wall board directly to studs with glue;

applying a fluid-applied water-resistive barrier on an outer surface of the inner cement wall board;

applying a cement or concrete compatible adhesive on the water-resistive barrier; and attaching an outer cement wall board to the fluid-applied water-resistive barrier using the cement or concrete compatible adhesive, wherein the cement or concrete compatible adhesive forms drainage channels between the inner cement wall board and the outer cement wall board.

11. The method of claim 10, wherein the cement or concrete compatible adhesive forms a plurality of vertical strips spaced a predetermined distance from adjacent vertical strips.

12. The method of claim 11, wherein said predetermined distance is approximately ¾ to 1½ inches.

13. The method of claim 11, wherein the vertical strips are approximately ⅜ inch in thickness.

14. The system of claim 6, wherein the inner cement wall board is attached to the studs using glue and screws.

15. The system of claim 7, wherein the inner cement wall board is attached to the studs using glue and screws.

16. The method of claim 10, wherein the inner cement wall board is attached to the studs using glue and screws.

* * * * *